US006992443B2

(12) United States Patent
Lin et al.

(10) Patent No.: US 6,992,443 B2
(45) Date of Patent: Jan. 31, 2006

(54) PLASMA DISPLAY PANEL

(75) Inventors: Yih-Jer Lin, Kaohsiung (TW); Yao-Ching Su, Taoyuan (TW)

(73) Assignee: Au Optronics Corp., Hsinchu (TW)

( * ) Notice: Subject to any disclaimer, the term of this patent is extended or adjusted under 35 U.S.C. 154(b) by 155 days.

(21) Appl. No.: 10/793,411

(22) Filed: Mar. 4, 2004

(65) Prior Publication Data

US 2005/0093452 A1 May 5, 2005

(30) Foreign Application Priority Data

Oct. 29, 2003 (TW) ..... 92130000 A

(51) Int. Cl.
*H01J 17/49* (2006.01)

(52) U.S. Cl. ..... 313/582; 313/587

(58) Field of Classification Search ..... 313/582–587
See application file for complete search history.

(56) References Cited

*Primary Examiner*—Vip Patel
(74) *Attorney, Agent, or Firm*—Thomas, Kayden, Horstemeyer & Risley

(57) ABSTRACT

A plasma display panel. The plasma display panel includes a first panel, a second panel, and a filter device. The first panel has a first substrate, a plurality of first electrodes and a protective layer. The first electrode is disposed in the vicinity of the first substrate and the protective layer. The second panel has a second substrate, a plurality of barrier ribs and a plurality of second electrodes. The barrier ribs and the second electrodes are formed on the second substrate. The barrier ribs create a plurality of cells. Center points of any three adjacent cells are connected to form an delta. The filter device includes a metallic mesh film, disposed on the first panel. The mesh film has wires intersecting each other. One of the wire and a side of the delta form an acute angle of 0 to 15 or 45 to 60°.

15 Claims, 9 Drawing Sheets

PLASMA DISPLAY PANEL

BACKGROUND OF THE INVENTION

1. Field of the Invention

The present invention relates to a plasma display panel (PDP), and in particular to a plasma display panel having a closed delta cell structure and an electromagnetic interference (EMI) device.

2. Description of the Related Art

In a PDP, high voltage through a low pressure gas produces a large magnetic field, thus generating light. The electromagnetic emissions from the magnetic field are governed by Class A and Class B limits of Federal Communications Commission (FCC) standards. Thus, the PDP must be designed in compliance with FCC EMI testing and verification. In the U.S., the FCC requires compliance with Class A for PDP operated in industrial settings and Class B—the stricter standard—in PDP for home use. Additionally, due to high manufacturing costs, most conventional PDPs are designed for industry use.

Due to rapid development of the PDP market in recent years, manufacturing costs have decreased, and particularly when residential space is limited, PDP has gradually become a popular display apparatus. However, PDP meeting FCC EMI Class A is inadequate for home use since the high EMI current of the PDP may interfere with other household appliances such as a home stereo system. Additionally, high EMI level is harmful to health. Thus, home-use PDP must also meet the Class B requirement.

FIG. 1 is a schematic diagram showing an internal structure of a conventional PDP 100'. The conventional PDP 100' comprises a filter substrate 10', a front panel 20' and a rear panel 30'. The filter substrate 10' is disposed on the exterior edge of the PDP 100', above the front panel 20'. The rear panel 30' is disposed at the bottom position of FIG. 1. The filter substrate 10' and the front panel 20' are connected by a frame (not shown here) with a gap 15' therebetween.

The front panel 20' includes a front glass 22', a pair of transparent electrodes 24', a bus electrode 26', a dielectric layer 25' and a protective layer 28'. The rear panel 30' includes phosphor 33', barrier ribs 31', a second dielectric layer 34', a pair of address electrodes 35' and a second substrate 36'. The barrier rib 31' is formed above the address electrodes 35' of the rear panel 30'. Many barrier ribs 31' constitute a discharge region or cell. The conventional PDP 100' can be implemented with different cell structures, such as a strip-cell structure, a grid-cell structure, and the delta-cell structure.

The filter substrate 10' not only protects the panel from damage, but also blocks infrared rays to improve optical performance and prevent electromagnetic interference. The filter substrate 10' has two types of structure. As shown in FIG. 2A, the first filter substrate 10*a*' comprises an anti-reflection film 12' (hereinafter called the "AR film"), an EMI mesh film 11*a*', a glass substrate 23', and a near-infrared radiation (NIR) film 14'. The EMI mesh film 11*a*' is an etching or conductive mesh film. The EMI mesh film 11*a*' and other films are disposed on both sides of the glass substrate 23'. Next, the filter substrate 10' is disposed on the front panel 20' with a gap 15' between the filter substrate 10' and the front panel 20', as shown in FIG. 1. The AR film 12' reduces light reflection from the outside and absorbs infrared ray for better optical performance.

The EMI mesh film 11*a*' of the first filter substrate 10*a*' is only applicable for the strip- or grid-cell structure type PDP. The delta cell structure, especially the closed type, is the most advanced cell structure. If the EMI mesh film 11*a*' is disposed in a PDP with closed-type delta cell structure, the EMI mesh film 11*a*' acts as an optical grating, producing an adverse effect of visible lines on the display, interfering with users. As a result, if the conventional filter substrate 10' is disposed in the PDP with closed-type delta cell structure, the PDP cannot pass Class B standards, and its display quality further suffers.

FIG. 2 is a schematic diagram showing another filter device 10*b*' with a glass substrate 24' and a silver (Ag) or indium tin oxide (ITO) sputtered thin film disposed thereon. Conventional filter device 10*b*' may comprise ITO film. However, a more recently developed filter device 10*b*' has silver sputtered film disposed on the glass substrate 23' for better EMI and NIR blocking ability.

Generally, neither the resistance of silver nor ITO is high enough for sufficient EMI shielding. For example, ITO film has a low resistance of 150Ω. If the film is thicker, despite improved blocking ability, light penetration ability is decreased. Also, the PDP may only meet FCC Class A requirement, not FCC Class B. Thus, since the conventional EMI mesh film insufficient for blocking electromagnetic waves, the PDP with such EMI film is inappropriate for domestic use.

As mentioned above, PDP requires EMI mesh film to be disposed on a glass substrate 23', and in a PDP with delta cell structure, use of the conventional EMI mesh film may only meet FCC Class A requirements. Hence, there is a need for a modified EMI mesh film for PDP, according to different cell structures, which can meet both FCC Class A and B requirements and improve display quality.

SUMMARY OF THE INVENTION

Thus, an object of the invention is to provide a PDP with a modified EMI film that can meet FCC Class B requirements even with delta cell structure.

Another object of the invention is to provide a PDP with effective EMI shielding without lowered display quality.

The present invention provides a PDP comprising a first panel, a second panel, and a filter device. The first panel has a first substrate, a plurality of first electrodes and a protective layer. The first electrode is disposed in the vicinity of the first substrate and the protective layer. The second panel has a second substrate, a plurality of barrier ribs, and a plurality of second electrodes. The barrier ribs and the second electrodes are formed on the second substrate. The barrier ribs create a plurality of cells. Center points of any three adjacent cells are connected in a delta configuration. The filter device includes a metallic mesh film, disposed on the first panel. The mesh film comprises wires intersecting each other. One wire and one side of the delta form an acute angle in a range of 0 to 15 or 45 to 60°.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

Plasma display panels (PDP) are divided into DC and AC types. Recently, the most popular PDPs on the market are AC type. Thus, the present invention mainly focuses on discussion thereof.

Figure 1:
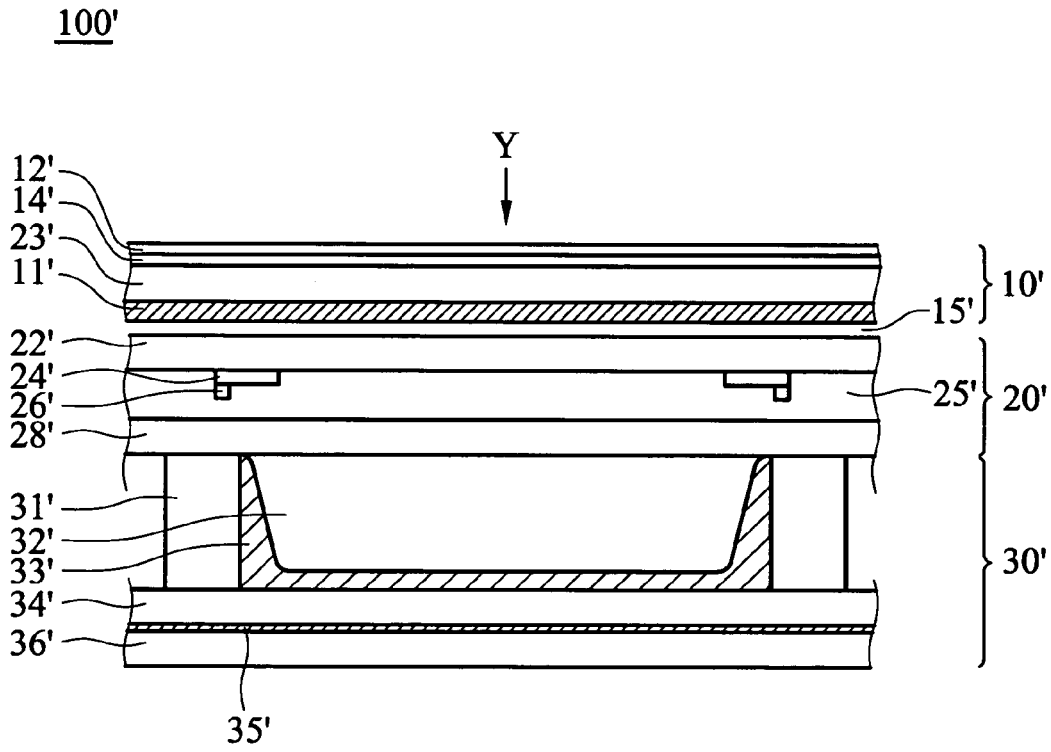
FIG. 1 (RELATED ART)
FIG. 1 is a schematic diagram showing internal structure of a conventional PDP 100'.
Figure 2A:
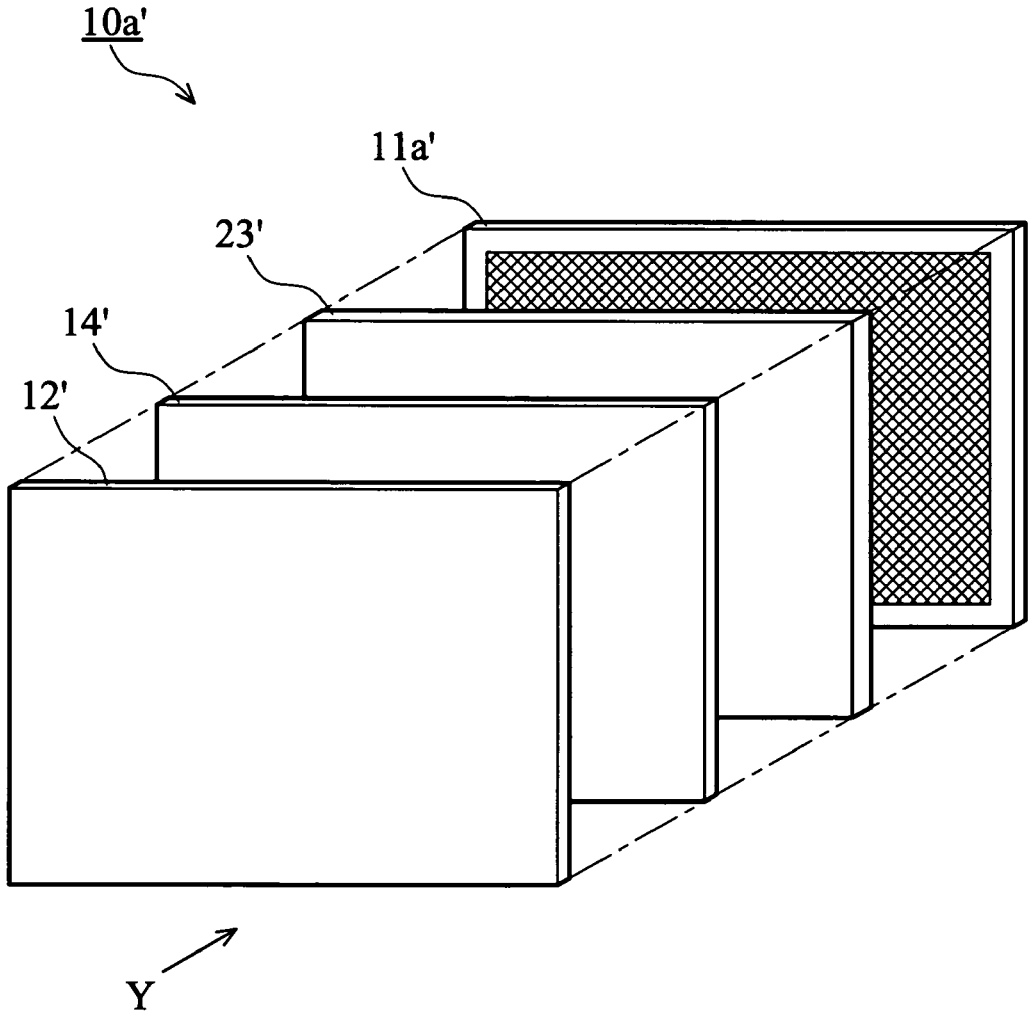
FIG. 2A (RELATED ART)
FIG. 2A is an exploded view of a conventional filter substrate.
Figure 2B:
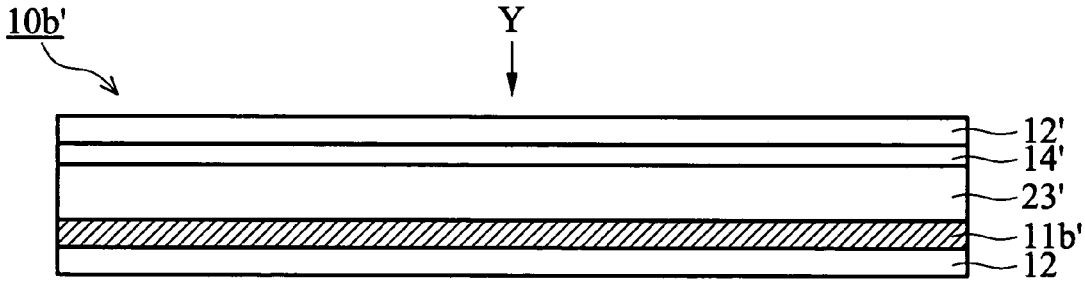
FIG. 2B (RELATED ART)
FIG. 2B is a side view of another conventional filter device.
Figure 3:
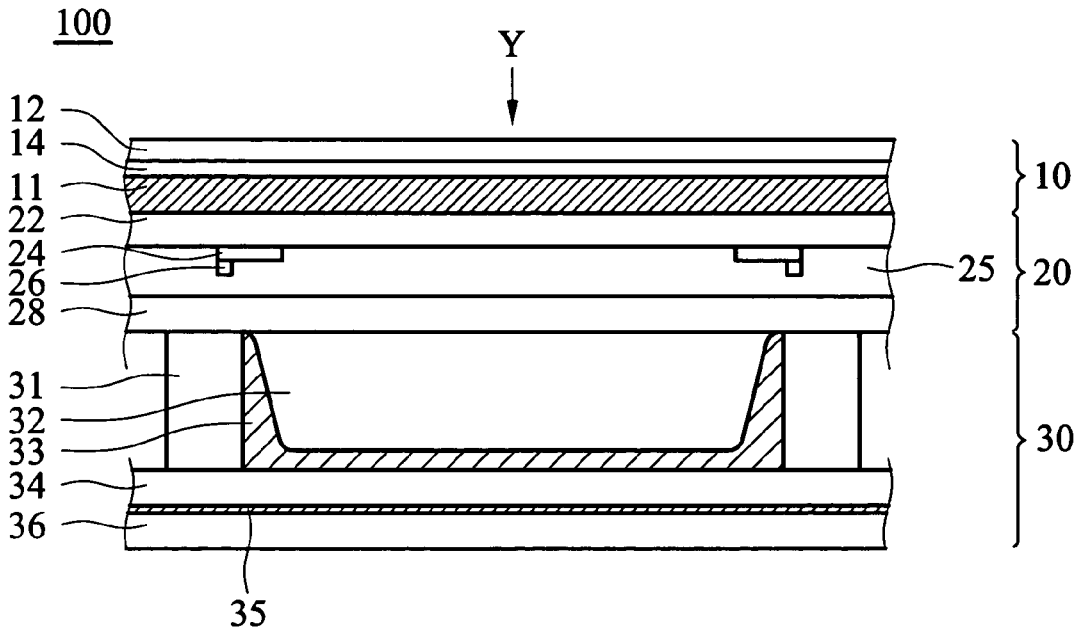
FIG. 3 is a cross section of a plasma display panel according to the present invention.
Figure 4:
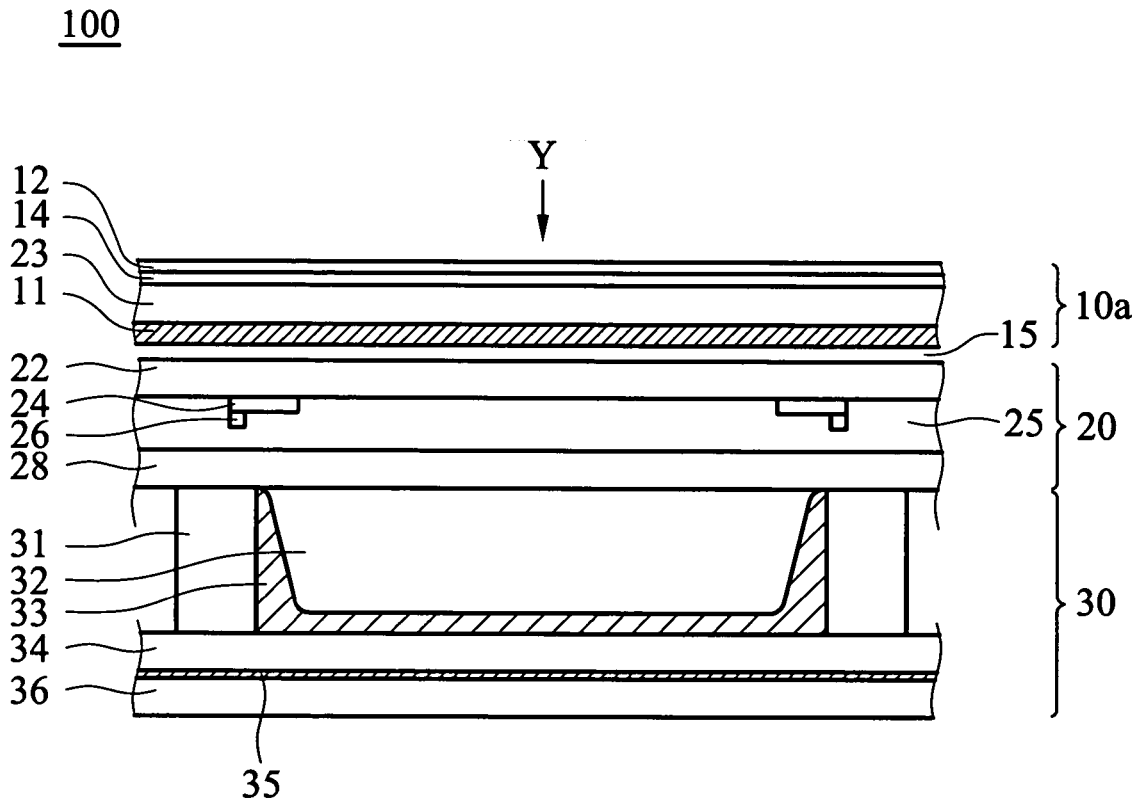
FIG. 4 is a schematic view of another plasma display panel according to the present invention.

FIGS. 3 and 4 are schematic views of plasma display panel 100 according to the present invention. The PDP 100 includes a plurality of cells, also referred to as discharge regions. For clear illustration, only one discharge region is shown in both figures.

As shown in FIG. 3, the PDP 100 includes a filter device 10, a first panel 20, and a second panel 30. The filter device 10 is disposed on the top position of FIG. 3. The first panel 20 is disposed between the filter device 10 and the second panel 30. The first panel 20 has a first substrate 22, and the filter device 10 is disposed thereon.

The filter device 10 has a metallic mesh film 11, an anti-reflection film 12, and a near-infrared radiation film 14. The metallic mesh film 11 comprises a plurality of wires intersecting each other. A detailed description of this intersection is discussed later. The anti-reflection film 12 and a near-infrared radiation film 14 are disposed on the metallic mesh film 11. The anti-reflection film 12 and the near-infrared radiation film 14 are capable of blocking electromagnetic waves and near-infrared radiation, respectively. In this embodiment, the metallic mesh film 11 comprises copper wires.

The filter device 10 of the present invention can also be arranged as shown in FIG. 4, wherein the filter device 10*a* comprises another filter glass 23 and a metallic mesh film 11. In this case, the metallic mesh film 11 is not directly disposed on the first panel 20. The filter device 10*a* and the first panel 20 have a gap 15 therebetween. The filter device 10*a* also has an anti-reflection film 12 and a near-infrared radiation film 14, respectively disposed on the metallic mesh film 11. The anti-reflection film 12 is made of acrylic resin.

In the present invention, the metallic mesh film 11 is directly disposed on the first panel 20 or on an additional filter substrate 23, with both arrangements providing full protection against EMI emissions.

The first panel 20 comprises a first substrate 22, a pair of transparent electrodes 24, a pair of auxiliary electrodes 26, a first dielectric layer 25, and a protective layer 28. In FIGS. 3 and 4, viewer direction is indicated by an arrow Y. The glass substrate facing the viewer is first substrate 22. The transparent electrodes 24 discharge and display. By controlling the discharge intensity of the transparent electrodes 24, the intensity of the visible light generated by a UV-excitable phosphor 33 is controlled. Thus, light is emitted from the phosphor 33, passing through the transparent electrode 24 and the first substrate 22. The auxiliary electrodes 26 are disposed on the transparent electrodes 24 to increase conductivity thereof. The protective layer 28 is a magnesium oxide (MgO) layer disposed on the first dielectric layer 25. The protective layer 28 is disposed on the electrodes 24, 26 to protect the first substrate 22 from damage, thereby preventing exhaustion of the electrodes 24, 26.

The second panel 30 has phosphor 33, barrier ribs 31, a second dielectric layer 34, address electrodes 35, and a second substrate 36. The second panel 30 is disposed below the first substrate 20, namely, at the bottom position of FIGS. 3 and 4. The address electrode 35 receives the display data written thereonto. Since each address electrode 35 is linearly disposed, it must be arranged according to locations of the electrodes 24, 26 of the first panel 20 for correct writing thereto. The address electrode is also referred to as data electrode. Each intersection of an address electrode 35 and a pair of transparent electrodes 24 is a discharge region or cell 32, formed by a plurality of barrier ribs 31 disposed above the address electrode 35 of the second panel 30. The discharge cell may be rectangular or honeycombed. Thus, PDP uses UV light emitted by a gas arc in the discharge cell 32 to excite red (R), green (G) and blue (B) phosphorous materials 33, finally generating visible light when the excited phosphorous materials 33 return to ground state.

In the present invention, the structure of the metallic mesh film 11 is the main factor in EMI blocking; thus, the following paragraph describes the angle required between the wires of the metallic mesh film 11 and the cell structure. By obtaining the optimum angle formed by the wires of the metallic mesh film 11 and the cell structure, the PDP according to the present invention can more thoroughly meet FCC Class B requirements.

Figure 5A:
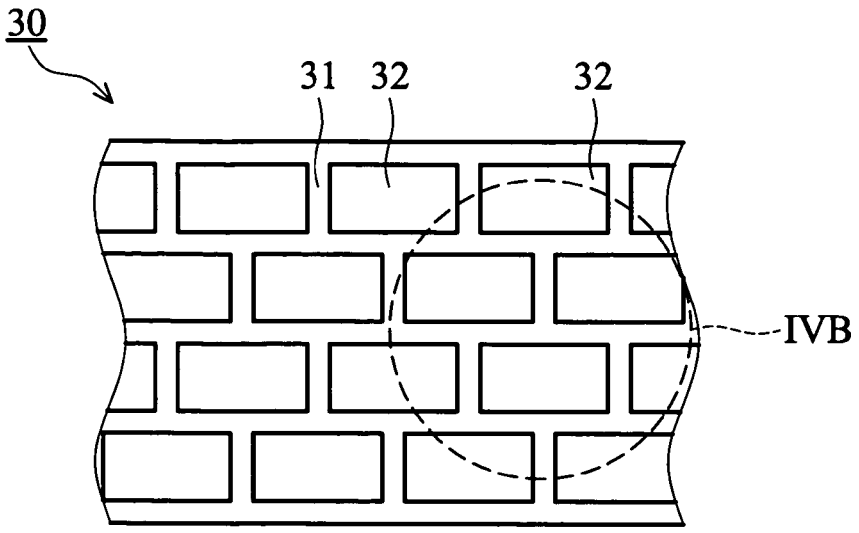
FIG. 5A is a schematic view of a rectangular barrier rib structure viewed from Direction Y of FIGS. 3 and 4.
Figure 5B:
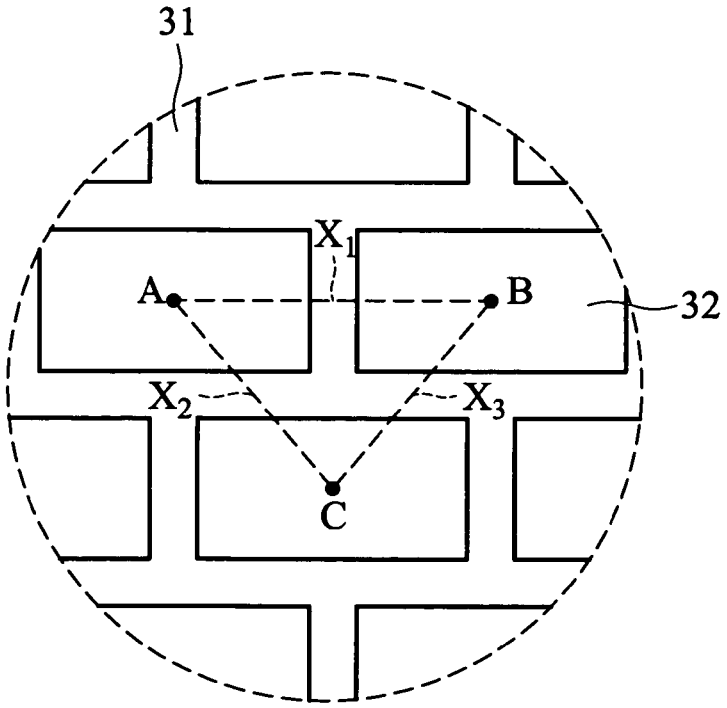
FIG. 5B is an enlarged view of FIG. 5A showing a dashed delta according to the present invention.

As mentioned above, the discharge cells 32 can be arranged in a strip-cell structure, a grid-cell structure, or a delta-cell structure. Among these structures, the delta structure is the most recently developed. The PDP 100 according to the present invention has barrier ribs 31 forming the discharge cells 32 in a closed delta structure. As shown in FIG. 5A, viewed from direction Y of FIGS. 3 and 4, the second panel 30 has a plurality of barrier ribs 31 forming rectangular discharge regions 32. FIG. 5B is an enlarged view of FIG. 5A showing a dashed delta, formed by connecting center points of any three adjacent discharge regions 32. Each center point is the vertex of the dashed delta with symbols of A, B, and C. The dashed delta has three sides $X_1$, $X_2$, and $X_3$.

Figure 6:
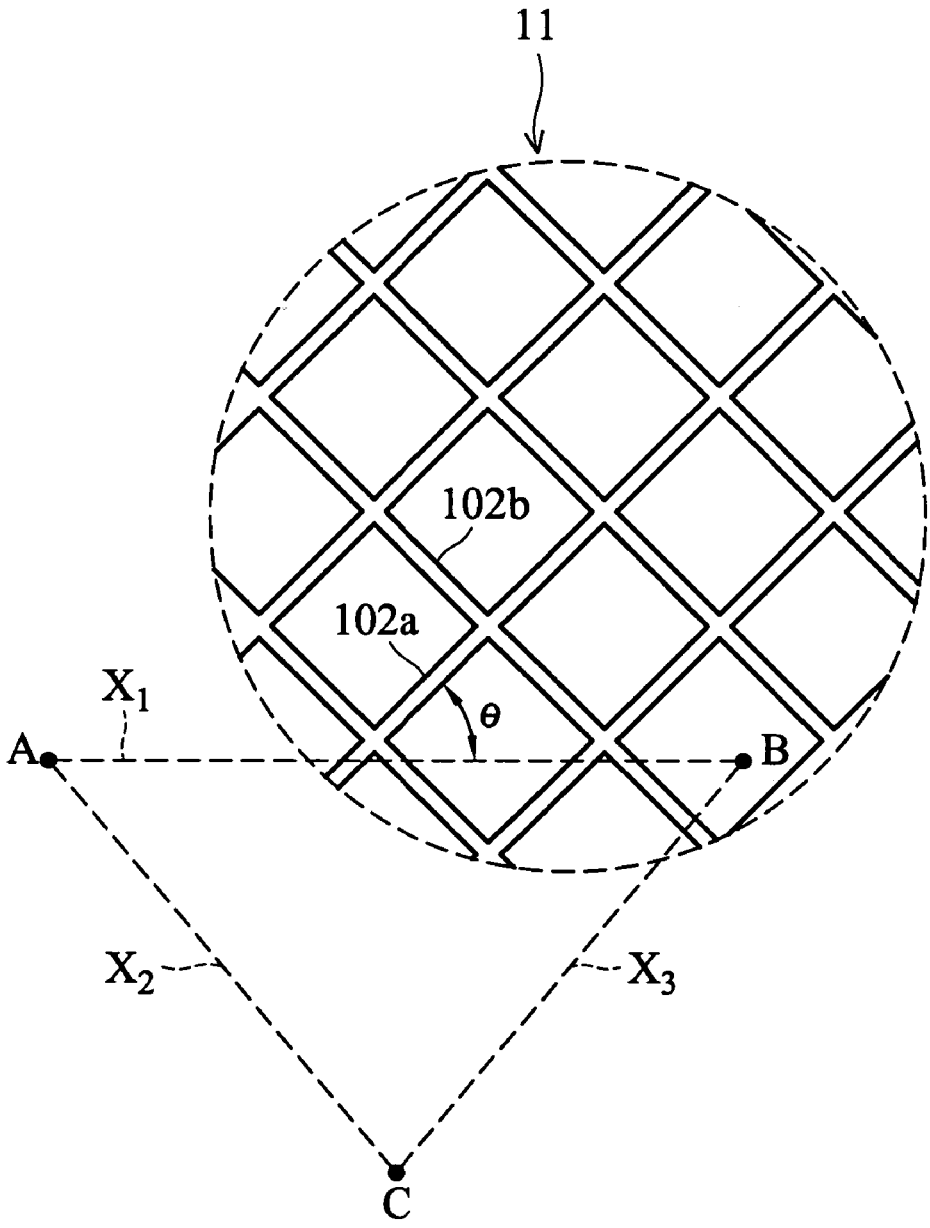
FIG. 6 is a local enlarged view of a metallic mesh film with respect to the dashed delta of FIG. 5B.

FIG. 6 is a local enlarged view of the metallic mesh film 11 with respect to the dashed delta of FIG. 5B. The metallic mesh film 11 is formed by a plurality of wires 102*a*, 102*b*. Each wire 102*a* and a side $X_1$ of the dashed delta form an angle θ. The preferred angle θ is found to be in a range from 0 to 15 or 45 to 60°. It has been experimentally found that an angle θ of 0 to 3 degrees provides optimized EMI shielding for PDP.

Figure 7A:
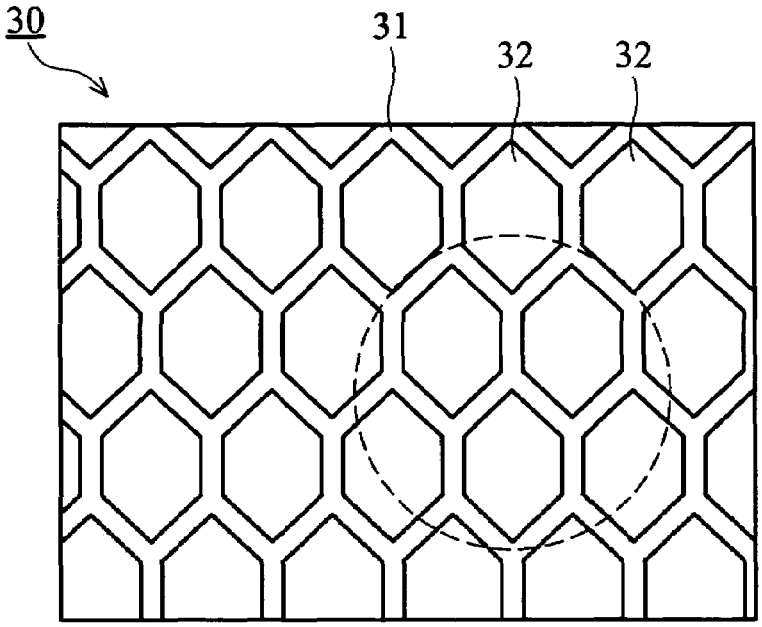
FIG. 7A is a schematic view of a honeycombed barrier rib structure viewed from Direction Y of FIGS. 3 and 4.
Figure 7B:
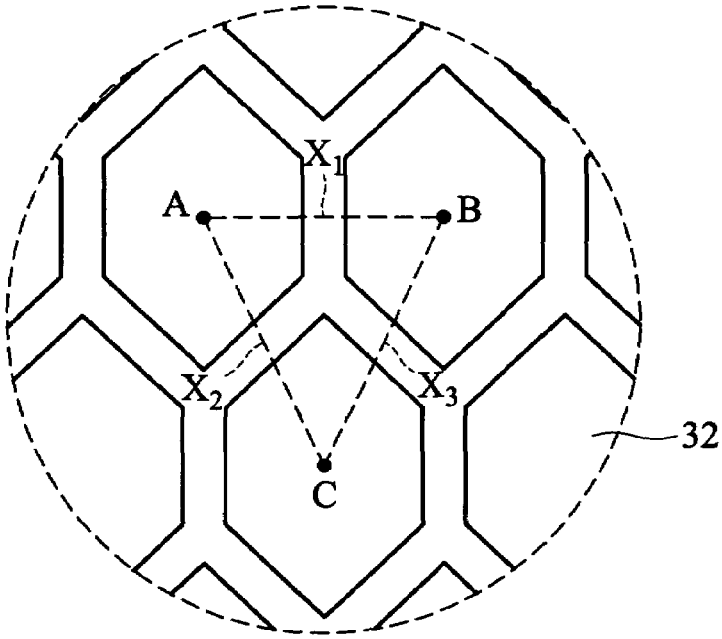
FIG. 7B is an enlarged view of FIG. 7A showing a dashed delta according to the present invention.
Figure 8:
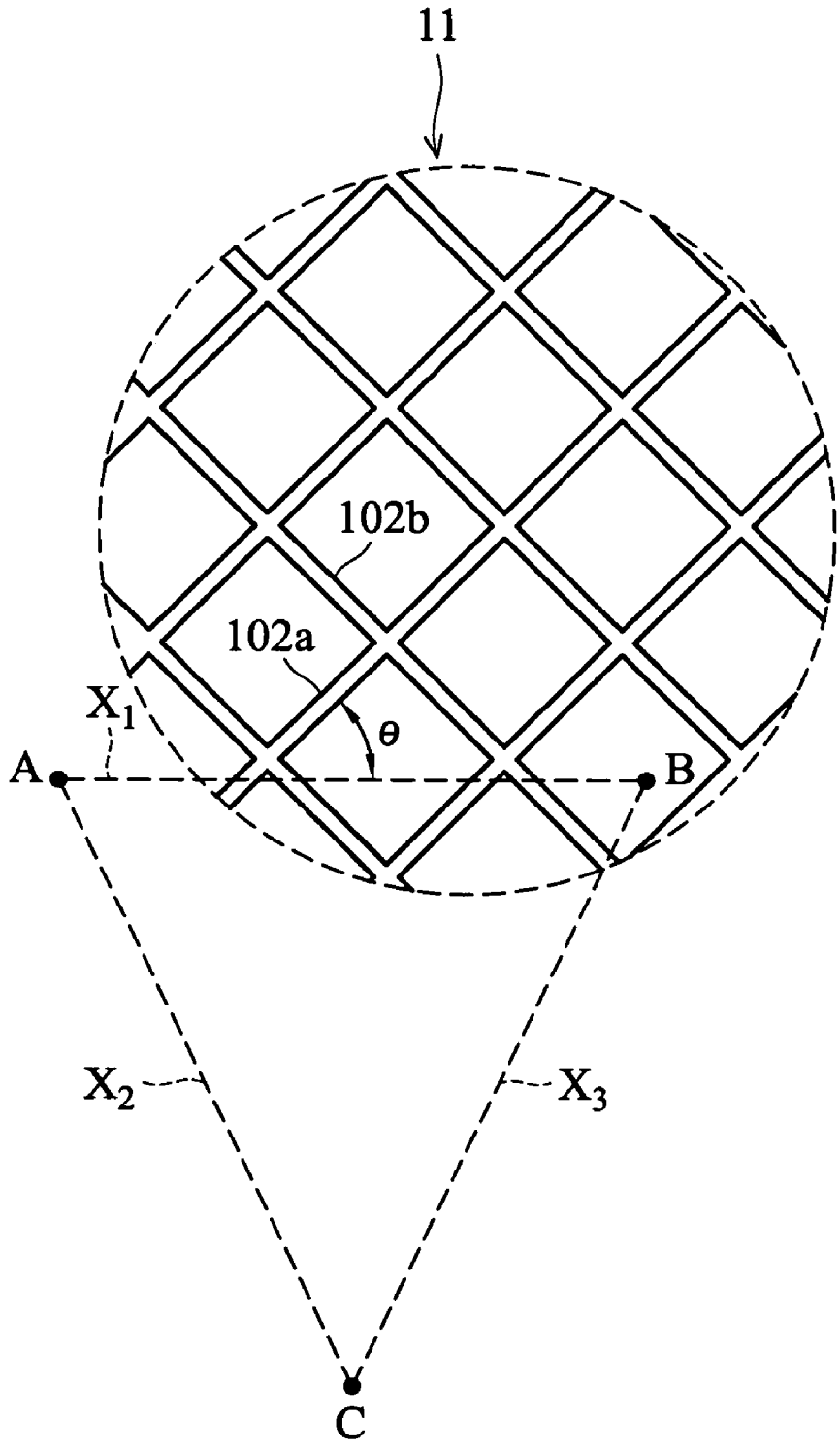
FIG. 8 is a local enlarged view of a metallic mesh film with respect to the dashed delta of FIG. 7B.

Each discharge cell 32 formed by the barrier ribs 31 can be honeycombed. FIG. 7A is a schematic view of honeycombed barrier rib 31 structure viewed from Direction Y of FIGS. 3 and 4. FIG. 7B is an enlarged view of FIG. 7A showing a dashed delta. As shown in FIGS. 7A and 7B, center points A, B, C of any three adjacent honeycombed discharge cells 32 are connected to form a dashed delta having three sides $X_1$, $X_2$, and $X_3$. FIG. 8 is a local enlarged view of the metallic mesh film 11 with respect to the dashed delta of FIG. 7B. One of the wires 102*a* of the metallic mesh film 11 and one side $X_1$ of the dashed delta form an angle θ. A preferred angle θ is found to be in a range from 0 to 15 or 45 to 60°. In several tests, it is shown that an angle θ of 0 to 3 degrees provide optimized EMI shielding for PDP.

Moreover, as mentioned, the metallic mesh film 11 is made of copper. The copper has resistance lower than that of silver or ITO, providing better EMI shielding. Thus, the PDP according to the present invention can pass FCC Class B standards. In addition, a PDP having a metallic mesh film with the designated angle θ of 0 to 15 or 45 to 60° can prevent visible lines.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A plasma display panel, comprising:

a first panel having a first substrate, a plurality of first electrodes, and a protective layer, wherein the first electrodes are disposed in the vicinity of the first substrate and the protective layer;

a second panel, disposed in the vicinity of the first panel, having a second substrate, a plurality of barrier ribs and a plurality of second electrodes, wherein the barrier ribs and the second electrodes are formed on the second substrate, and the barrier ribs create a plurality of cells; and center points of any three adjacent cells are connected to form an delta; and a filter device having a metallic mesh film, disposed on the first panel, including a plurality of wires, in which an angle formed between one of the wires and a side of the delta is an acute angle of 0 to 15 or 45 to 60°.

2. The plasma display panel as claimed in claim 1, wherein each of the cells is rectangular.

3. The plasma display panel as claimed in claim 1, wherein each of the cells is honeycombed.

4. The plasma display panel as claimed in claim 1, wherein the metallic mesh film comprises copper.

5. The plasma display panel as claimed in claim 1, wherein the angle is between 0 to 3°.

6. The plasma display panel as claimed in claim 1, wherein the filter device further comprises an anti-reflection film and a near-infrared radiation film, respectively disposed in the vicinity of the metallic mesh film.

7. The plasma display panel as claimed in claim 6, wherein the anti-reflection film includes acrylic resin.

8. A plasma display panel, comprising:

a first panel having a first substrate, a plurality of first electrodes, and a protective layer, wherein the first electrodes are disposed in the vicinity of the first substrate and the protective layer;

a second panel, disposed in vicinity of the first panel, having a second substrate, a plurality of barrier ribs and a plurality of second electrodes, wherein the barrier ribs and the second electrodes are formed on the second substrate, and the barrier ribs create a plurality of cells; and center points of any three adjacent cells are connected to form an delta; and a filter device, disposed on the first panel, having a metallic mesh film and a filter substrate, wherein the metallic mesh film is disposed on the filter substrate, comprising a plurality of wires, in which an angle formed between one of the wires and a side of the delta is an acute angle of 0 to 15 or 45 to 60°.

9. The plasma display panel as claimed in claim 8, wherein a gap is formed between the filter device and the first panel.

10. The plasma display panel as claimed in claim 8, wherein each of the cells is rectangular.

11. The plasma display panel as claimed in claim 8, wherein each of the cells is honeycombed.

12. The plasma display panel as claimed in claim 8, wherein the metallic mesh film comprises copper.

13. The plasma display panel as claimed in claim 8, wherein the angle is between 0 to 3 degrees.

14. The plasma display panel as claimed in claim 8, wherein the filter device further has an anti-reflection film and a near-infrared radiation film, respectively disposed in vicinity of the metallic mesh film.

15. The plasma display panel as claimed in claim 14, wherein the anti-reflection film includes acrylic resin.

* * * * *